US005137262A

United States Patent [19]

Clempson et al.

[11] Patent Number: 5,137,262

[45] Date of Patent: Aug. 11, 1992

[54] STEEL-MAKING VESSELS

[75] Inventors: Michael Clempson, Polesworth; Wynne Purchase, Port Talbot, both of United Kingdom

[73] Assignee: Goricon Metallurgical Services Limited, Mid Glamorgan, United Kingdom

[21] Appl. No.: 689,912

[22] PCT Filed: Nov. 28, 1989

[86] PCT No.: PCT/GB89/01424

§ 371 Date: May 29, 1991

§ 102(e) Date: May 29, 1991

[87] PCT Pub. No.: WO90/06377

PCT Pub. Date: Jun. 14, 1990

[30] Foreign Application Priority Data

Dec. 1, 1988 [GB] United Kingdom ..... 8828041
Apr. 29, 1989 [GB] United Kingdom ..... 8909908

[51] Int. Cl.[5] ..... C21B 7/12
[52] U.S. Cl. ..... 266/45
[58] Field of Search ..... 266/45

[56] References Cited

U.S. PATENT DOCUMENTS 4,471,950 9/1984 LaBate ..... 266/45
4,913,404 4/1990 Warman ..... 266/45

*Primary Examiner*—Peter D. Rosenberg
*Attorney, Agent, or Firm*—Young & Thompson

[57] ABSTRACT

An insert 6 is pushed into an eroded tap hole 5 of a steel-making vessel. This insert has outer and inner plates 7 and 8 formed from relatively thin steel sheet or cardboard which will flex so as to adapt itself to the internal dimensions of the tap hole 5 as shown. Between the two plates 7 and 8 there is a tubular support member 9 defining a central passage-way 10 which has holes 11 formed on its side walls which communicate with the open volume 12 between the end plates 7 and 8. A supply hose 13 is connected to the tubular member 10, through which a settable material comprising a clay and binder in wet form is injected so that the whole volume between the end plates 7 and 8 is filled. At the temperatures experienced the clay material will set rapidly so as to block off the tap hole 5. When the steel has been formed and the steel-making vessel is tipped to enable the molten steel to be poured off through the tap hole, the hot molten material will rapidly melt the steel insert 6 and the set clay material, thus re-opening the tap hole 5.

7 Claims, 2 Drawing Sheets

STEEL-MAKING VESSELS

When steel is being formed, the raw materials are fed into a heated vessel and the formed molten steel is ultimately poured out through a tap hole in a side wall as the vessel is tipped. It is highly desirable that the tap hole should be blocked off during the steel-making process for two main reasons. Firstly, this prevents the passage of air through the tap hole into the interior of the vessel during the forming of the steel, which helps to control the nature of the gas within the vessel during the forming process. Secondly, when the vessel is tipped to pour out the molten steel it is important to avoid the possibility that the slag floating on top of the steel should pass through the tap hole as the edge of the liquid first arrives at the tap hole.

Because of the conditions, particularly extremely high temperatures, existing in the area of the steel-making vessel, and the fact that the tap hole attains a very irregular shape with use, it is difficult to achieve blocking of the tap hole and it is an object of this invention to alleviate this particular problem.

Accordingly, the invention provides a tap hole blocking insert for a steel-making vessel comprising a former constructed from a material which is stable at low refractory temperatures, but which will melt at high refractory temperatures, and which is sufficiently flexible to bend when inserted into the tap hole, the former defining a centre cavity, open at the sides, between two end plates shaped to grip the sides of the interior of the tap hole, and an inlet passageway leading to the cavity for the injection of a settable material.

The low refractory temperatures referred to above are those which are likely to be experienced in the region of the tap hole during the steel-forming process and these typically might be within the region of 600° to 700° C.

The invention also extends to a method of blocking a tap hole, using an insert of this invention as hereinbefore defined, which comprises introducing the insert into the tap hole whilst the steel-making vessel is in the upright condition, and pressing the insert home as a tight fit within the tap hole, followed by injection of a material in wet form which will set at the low refractory temperatures to fill the space between the plates of the insert so as to block the tap hole, the set material being such that it will melt when subjected to the high refractory temperatures experienced during pouring of the molten steel.

In one embodiment the insert may have an axial support member connected between the plates but having holes in its side walls through which the settable material can pass. Alternatively the end plates may be held apart by spacer rods so as to define the centre cavity. These rods are ideally threaded so that the distance between the end plates may be varied as required and fixed by means of nuts.

In the preferred arrangement the edges of the plates of the insert are designed to flex as the insert is pressed into the tap hole so that the insert will adapt itself to the irregular shape of the tap hole. A particular preferred material for forming the end plates of the former is cardboard which has been found to have the necessary stability to remain in place at the high temperatures experienced for long enough to enable the settable material to be injected and set. For this purpose, therefore, cardboard is regarded as a material which is stable at low refractory temperatures. If desired, the cardboard sheets could be coated or impregnated with a flame-retardant solution. The use of cardboard is particularly suitable since it is flexible and thus will adapt to the irregular shape of the hole being blocked. Advantageously radially extending cuts will be formed in the outer edges of the end plates.

Tubing might be connected to the inlet passageway through which a settable material can be injected. Alternatively a cartridge of the settable material could be attached to or provide the inlet passageway, so that a plunger can be operated to inject the material within the cartridge into the cavity.

From a further aspect the invention extends to the insert of this invention as hereinbefore defined in combination with the settable material and means for injecting the material into the insert, the settable material being of a nature that it will set when subjected to heat at the low refractory temperatures so as to be stable at those temperatures, but which will melt at the high refractory temperatures.

Suitable materials which might be used include clay together with a binder. The clay might be formed from a metal or non-metal oxide, such as magnesia or aluminium or silicon containing materials.

The invention may be performed in various ways and preferred embodiments thereof will now be described with reference to the accompanying drawings, in which.

Figure 1:
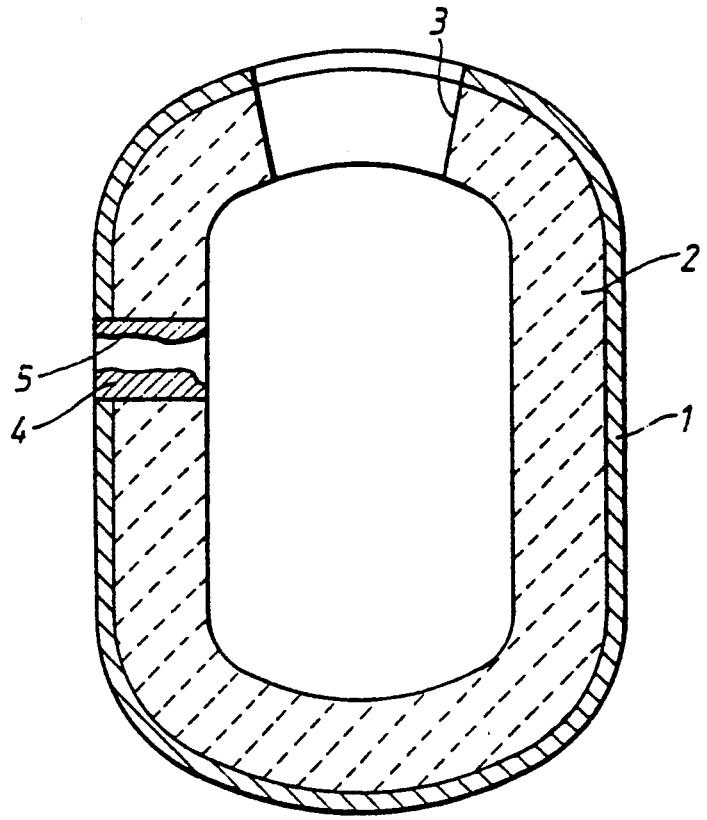
FIG. 1 is a vertical section through a steel-making vessel incorporating a plug defining a tap hole.

The steel-making vessel shown in FIG. 1 has an outer steel shell 1 lined internally with a thick wall 2 of refractory bricks. An opening 3 at the top provides for the insertion of steel-making materials. A plug 4 is fitted into the side wall of the vessel and defines a tap hole 5.

Figure 2:
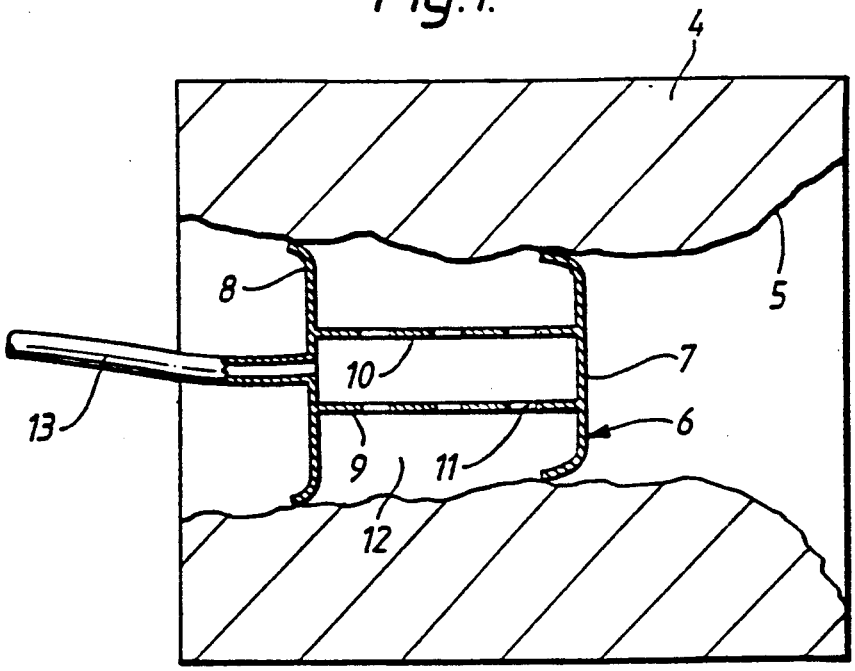
FIG. 2 is an enlarged cross-sectional view through the plug shown in FIG. 1 with a blocking insert of this invention therein.

As can be seen from FIG. 1, and more particularly from FIG. 2, after a number of uses the tap hole 5 becomes enlarged due to erosion and thus does not have a regular internal shape. A stage will be reached when the plug 4 needs to be replaced, but in the meantime various repair operations may be carried out. This particular invention is concerned with the need to block off the tap hole 5 during the stages of formation of the steel material within the vessel shown in FIG. 1. This is achieved by pushing an insert 6 into the tap hole 5. This insert has outer and inner plates 7 and 8 formed from relatively thin steel sheet which will flex so as to adapt itself to the internal dimensions of the tape hole 5 as shown. Between the two plates 7 and 8 there is a tubular support member 9 defining a central passage-way 10 which has holes 11 formed in its side walls which communicate with the open volume 12 between the end plates 7 and 8. A supply hose 13 is connected to the tubular member 10.

In use, after the insert 6 has been pushed into place, a settable material comprising a clay and binder in wet form is injected through the supply hose 13 into the tubular member 10 and then, through the holes 11, into the open space 12 so that the whole volume between the end plates 7 and 8 is filled. At the temperatures experienced (for the heated steel-making vessel) the clay material will set rapidly so as to block off the tap hole 5.

Whilst a hose 13 has been illustrated for supply of the settable material, it could advantageously be replaced, at least at the furnace end by a rigid tube which can act also as the means for pushing the insert 6 home. For example the plate 8 could have a large opening to receive the end of the rod, which will have a large collar near the open end thereof to rest against the plate 8 during the pushing operation.

When the steel has been formed and the steel-making vessel is tipped to enable the molten steel to be poured off through the tap hole, the hot molten material will rapidly melt the steel insert 6 and the set clay material, thus re-opening the tap hole 5. However, before this occurs, the slag level floating on top of the molten steel will have moved past the tap hole 5 so that little or no slag will be poured off through the tap hole 5, during the initial stages of pouring. Blocking off this tap hole is also advantageous during the steel-making process as it prevents air entering the steel-making vessel through that passageway.

Figure 3:
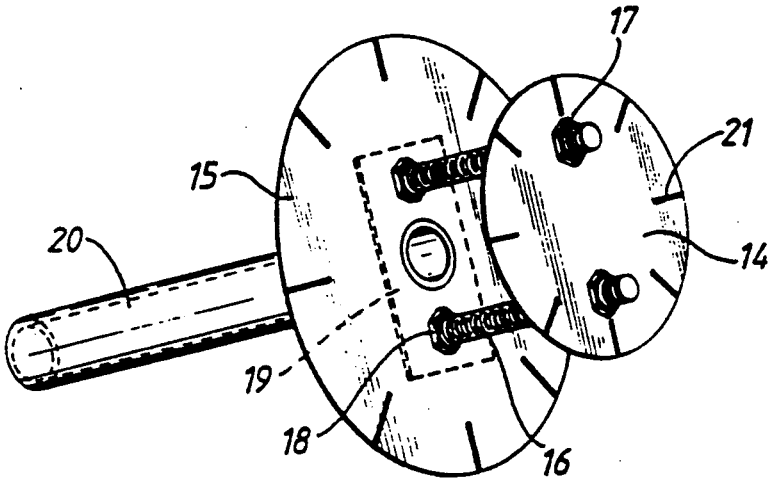
FIG. 3 is a perspective view of another embodiment of a blocking insert of this invention.

The former shown in FIG. 3 comprises a pair of end plates 14 and 15 spaced apart by a pair of threaded bolts 16 which are secured to the end plates 14 and 15 by nuts 17 and 18. A backing plate 19 provides a mounting for a support tube 20.

The end plates 14 and 15 are formed from cardboard material coated with a flame-retardant solution and cuts 21 are formed in the edges of the cardboard sheets to allow the edges to flex. In use the support tube 20 is mounted onto a lance and the former is then introduced into the enlarged tap hole to be plugged. The end plates 14 and 15 adapt to the irregular shape of the tap hole and thus define between them an enclosed cavity into which a settable material is injected through the lance and the support tube 20.

The support tube 20 could be constructed as a cartridge enclosing a charge of the settable material. A plunger could then be forced through the tube 20 to cause the settable material to be injected into the cavity between the two end plates 14 and 15. A similar operation could be achieved by replacing the supply hose 13 by a cartridge of settable material.

We claim:

1. A tap hole blocking insert for a steel-making vessel, comprising a former including two spaced end plates defining between them a cavity for a reception of a settable material between the end plates, one of the end plates having an inlet passageway therethrough for the injection of a said settable material into said cavity, the end plates having outer peripheries that are exposed to the side walls of the tap hole into which the former is to be inserted, the end plates having sufficient flexibility to bend in contact with said side walls in order to permit insertion of the former and having sufficient rigidity to retain the insert in the tap hole, the material of the end plates being fugitive at the temperature of molten steel so that the insert will not block the flow of molten steel through the tap hole when the vessel is tilted sufficiently to bring the tap hole below the level of the molten steel in the vessel.

2. A blocking insert as claimed in claim 1, there being a hollow axial support member extending between the end plates, said inlet passageway communicating with the interior of said axial support member, said axial support member having holes therethrough, through which said settable material can pass.

3. A blocking insert as claimed in claim 1, and spacer rods which hold the end plates apart, said rods being screw threaded, and nuts on the screw threaded spacer rods to adjust the distance between the end plates.

4. A blocking insert as claimed in claim 1, wherein said end plates have radially extending cuts formed in the outer edges thereof.

5. A blocking insert as claimed in claim 1, the end plates being cardboard.

6. A blocking insert as claimed in claim 1, the end plates being sheet steel.

7. A method of blocking a tap hole of a steel-making vessel, comprising introducing into the tap hole an insert comprising a former including two spaced end plates defining between them a cavity for a reception of a settable material between the end plates, one of the end plates having an inlet passageway therethrough for the injection of a said settable material into said cavity, the end plates having outer peripheries that are exposed to the side walls of the tap hole into which the former is to be inserted, the end plates having sufficient flexibility to bend in contact with said side walls in order to permit insertion of the former and having sufficient rigidity to retain the insert in the tap hole, the material of the end plates being fugitive at the temperature of molten steel so that the insert will not block the flow of molten steel through the tap hole when the vessel is tilted sufficiently to bring the tap hole below the level of the molten steel in the vessel, the method further comprising injection a settable material through said inlet passageway into said cavity and into contact with said side walls of the tap hole, said settable material being fugitive at the temperature of molten steel.

* * * * *